United States Patent [19]

Okada

[11] Patent Number: 4,624,369

[45] Date of Patent: Nov. 25, 1986

[54] METHOD OF AND APPARATUS FOR SORTING SLIDE FASTENERS

[75] Inventor: Yozo Okada, Toyama, Japan

[73] Assignee: Yoshida Kogyo K. K., Tokyo, Japan

[21] Appl. No.: 640,750

[22] Filed: Aug. 14, 1984

[30] Foreign Application Priority Data

Aug. 15, 1983 [JP] Japan ..... 58-149073

[51] Int. Cl.[4] ..... B07C 5/00

[52] U.S. Cl. ..... 209/626; 209/604; 209/658; 209/698; 209/906; 209/929; 209/940; 406/88

[58] Field of Search ..... 209/600, 601, 604, 625-628, 209/658, 698, 906, 929, 940; 29/408; 406/83, 88, 108

[56] References Cited

U.S. PATENT DOCUMENTS

| | | | |
|---|---|---|---|
| 1,612,023 | 12/1926 | Huber | 209/698 X |
| 2,492,564 | 12/1949 | Gauthier | 209/940 X |
| 2,805,898 | 9/1957 | Willis, Jr. | 209/906 X |
| 3,276,578 | 10/1966 | Harris et al. | 209/906 X |
| 3,480,140 | 11/1969 | Unkefer | 209/698 X |
| 4,131,320 | 12/1978 | Volat et al. | 406/88 |
| 4,161,251 | 7/1979 | Paul | 209/698 X |
| 4,247,230 | 1/1981 | Forster | 406/88 |
| 4,280,626 | 7/1981 | Batting et al. | 209/658 |

*Primary Examiner*—Randolph A. Reese
*Assistant Examiner*—Edward M. Wacyra
*Attorney, Agent, or Firm*—Hill, Van Santen, Steadman & Simpson

[57] ABSTRACT

Slide fasteners are fed longitudinally one at a time along a path by at least one stream of air flowing along the path, and are then introduced into a clearance or gate which is narrow enough to prevent the passage of sliders so that when the slide fasteners have respective sliders, they are stopped at the gate, while when the slide fasteners have no sliders, they are allowed to pass through the gate and be further advanced by the stream of air. Thus the slide fasteners are automatically sorted or separated into two groups according to the presence of the sliders. Thereafter, the stream of air is interrupted whereupon the slide fasteners stopped at the gate are allowed to fall from the path into a container disposed below the gate. The slide fasteners thus fallen are disposed in the container in juxtaposition.

11 Claims, 5 Drawing Figures

METHOD OF AND APPARATUS FOR SORTING SLIDE FASTENERS

BACKGROUND OF THE INVENTION

1. Field of the Invention

This invention relates to a method of and an apparatus for sorting good slide fasteners from the bad and then neatly stacking the good slide fasteners in juxtaposition.

2. Prior Art

Finished slide fasteners discharged one by one from a slide fastener processing machine are separated into two groups depending on the existence of sliders on the respective slide fasteners while they are moved on a belt conveyer. When a slide fastener having a slider is detected, the belt conveyer is stopped whereupon a pusher is actuated to displace the slide fastener laterally off the belt conveyer. The displaced slide fastener is allowed to fall into a container and stored therein as a good slide fastener. Slide fasteners without respective sliders mounted thereon are discharged from an unloading end of the belt conveyer and are collected in another container as bad slide fasteners. According to such prior sorting practice, frequent intermittent operation of the conveyer is liable to cause a misalignment between the pusher and the good slide fasteners with the result that the slide fasteners displaced off the conveyer by the pusher are disposed in the container at random.

SUMMARY OF THE INVENTION

It is therefore an object of the present invention to provide a method of and apparatus for sorting good slide fasteners with sliders from bad slide fasteners without sliders and then neatly stacking the good slide fasteners in juxtaposition.

Another object of the present invention is to provide a sorting apparatus which is simple in structure and which can be constructed at less cost.

According to the present invention, slide fasteners are fed longitudinally one at a time along a path by at least one stream of air flowing along the path, and are then introduced into a clearance or gate which is narrow enough to prevent the passage of sliders so that when the slide fasteners have respective sliders, they are stopped at the gate, while when the slide fasteners have no sliders, they are allowed to pass through the gate and are further advanced by the stream of air. Thus the slide fasteners are automatically sorted or separated into two groups according to the presence of the sliders. Thereafter, the stream of air is interrupted whereupon the slide fasteners stopped at the gate are allowed to fall from the path into a container disposed below the gate. The slide fasteners thus fallen into the container are disposed therein in juxtaposition. The slide fasteners without sliders are advanced by the stream of air and are then discharged from the apparatus through a chute disposed at the forward end of the path.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
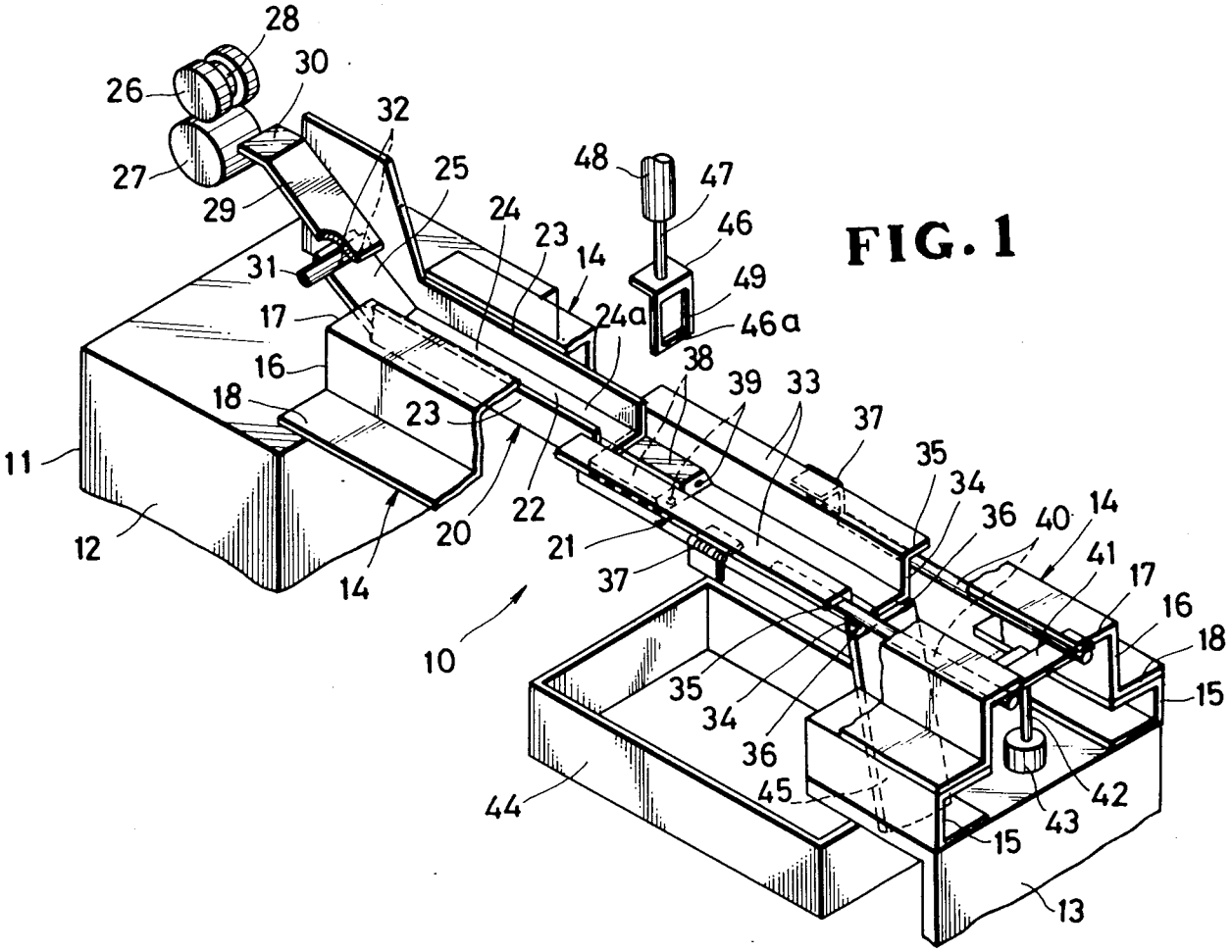
FIG. 1 is a fragmentary perspective view, with parts cut away for clarity, of a sorting apparatus embodying the present invention.

As shown in FIG. 1, a sorting apparatus 10 embodying the invention comprises a substantially U-shaped frame 11 (only the upper portion being illustrated) having a pair of spaced heads 12, 13, and a pair of parallel spaced elongate support bars 14, 14 mounted on and extending between the heads 12, 13. Each of the support bars 14 is connected at one end to the head 12 and at the other end to the head 13 with a spacer block 15 disposed between each of the support bars 14 and the head 13. The support bar 14 has a generally Z-shaped cross section and includes a vertical wall 16 and a pair of upper and lower horizontal walls 17, 18 extending from opposite edges of the vertical wall 16 in opposite directions. The upper walls 17, 17 of the support bars 14, 14 confront each other with an elongate space 19 (FIGS. 2 and 3) defined therebetween.

The apparatus 10 further includes a pair of elongate first and second guides 20, 21 mounted on the support bars 14 in end-to-end relationship with each other, the first guide being disposed adjacent to the head 12.

The first guide 20 is received in the elongate space 19 between the support bars 14, 14 and is supported at one end on the head 12. The guide 20 has a substantially U-shaped cross section and includes a bottom wall 22 and a pair of sidewalls 23, 23 extending from the opposite edges of the bottom wall 22 upwardly in a common direction. The bottom wall 22 has a first guide surface 24 on which bottom wall slide fasteners F (FIGS. 4A and 4B) advance one by one in closed condition with sliders S disposed substantially at the trailing ends of the respective slide fasteners F. The first guide surface 24 includes a substantially horizontal major portion **24*a* extending parallel to the support bars 14 and a sloped end portion 25 disposed remotely from the second guide 21. The sloped end portion 25 inclines upwardly away from the head 12 and is directed to a pair of feed rollers 26, 27 disposed above the head 12. The feed rollers 26, 27 are rotatably mounted on a slide fastener processing machine (not shown) and cooperate with each other in supplying the slide fasteners F one by one from the processing machine to the sorting apparatus 10. One of the rollers 26 has a circumferential guide groove 28 for the passage of the sliders S (FIGS. 4A and 4B) mounted on the slide fasteners F. An auxiliary guide plate 29 is mounted on the first guide 20 and extends in overlapping relation to the sloped end portion 25 of the first guide surface 24, the guide plate 29 having a substantially horizontal end portion 30 located near the nip between the rollers 26, 27. A first air ejector in the shape of a pipe 31 is disposed between the bottom wall 22 and the guide plate 29 and extends transversely across the guide surface 24. The pipe 31 has a plurality of nozzles or orifices 32 facing toward the other end of the first guide 20 so that when compressed air is supplied from a suitable source (not shown) to the pipe 31, streams of air ejected from the orifices 32 flow along the guide surface 24**.

Figure 2:
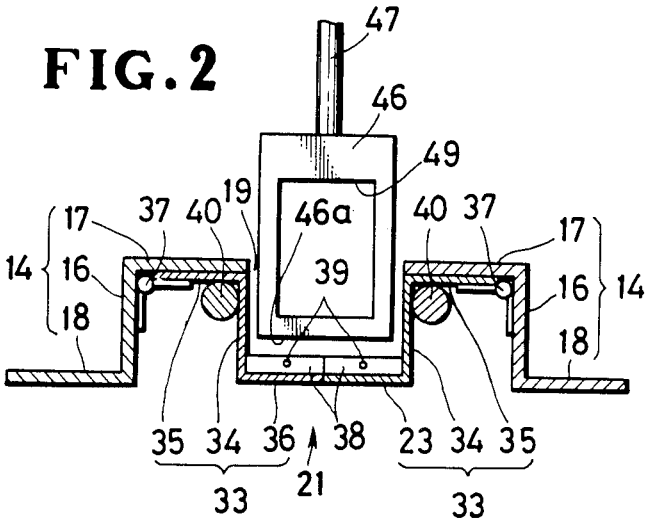
FIG. 2 is a cross sectional view showing slide fastener guide members of the sorting apparatus as they are in a slide fastener holding position.

The second guide 21 includes a pair of guide members 33, 33 pivotably mounted on the undersides of the respective support bars 14. Each of the guide members 33, 33 has a generally Z-shaped cross section and includes a vertical wall 34 and a pair of upper and lower walls 35, 36 extending perpendicularly from opposite edges of the vertical wall 34 in opposite directions. As shown in FIG. 2, the upper walls 35 are connected to the vertical walls 16 of the respective support bars 14 by means of a pair of hinges 37, and the lower walls 36 normally engage edgewise together to close the space 19. A second air ejector is in the form of a pair of flat hollow blocks 38, 38 disposed respectively on the lower walls 36 of the guide members 33 adjacent to the first guide 20. Each of the hollow blocks 38 has a nozzle or orifice 39 through which compressed air supplied from the air source is ejected to flow along the upper surface of the lower wall 36.

Figure 3:
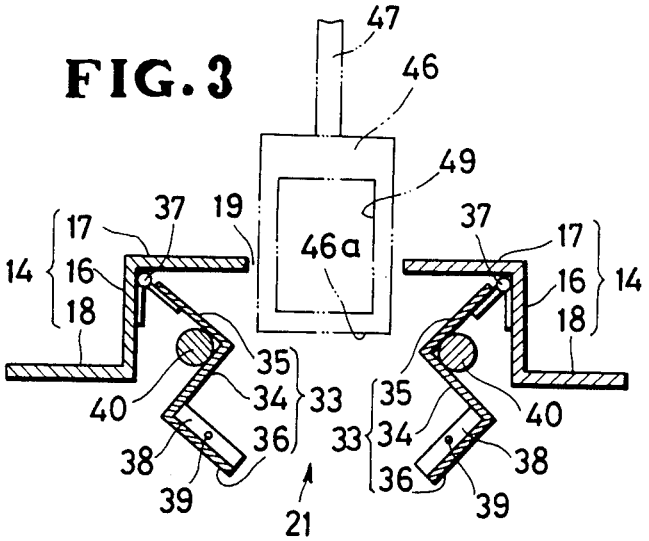
FIG. 3 is a view similar to FIG. 1, showing the slide fastener guide members in a slide fastener releasing position.

A pair of rods 40, 40 is secured at one end to the undersides of the respective upper walls 35 and projects from the respective guide members 33, 33 in a direction away from the first guide 20. The rods 40, 40 are supported at their distal ends on a horizontal support plate 41 connected to a piston rod 42 of a fluid-pressure actuator 43 which is vertically mounted on the head 13. With this construction, when the actuator 43 is driven to retract its piston rod 42, the rods 40, 40 move downwardly with the result that the guide members 33, 33 pivotably move away from each other to open the elongate space 19, as shown in FIG. 3.

A container 44 is disposed beneath the second guide 21 for receiving therein the slide fasteners F having the slider S. A chute 45 extends from the end of the second guide 21 which is remote from the first guide 20, for discharging the slide fasteners F without the sliders S from the sorting apparatus 10.

A stopper plate 46 is disposed above the flat hollow blocks 38 and is connected to a piston rod 47 of a fluid-pressure actuator 48 mounted on the frame 11. Thus the stopper plate 46 is vertically movable toward and away from the flat hollow blocks 38 upon operation of the actuator 48. The stopper plate 46 has a lower edge **46*a* extending normal to the direction of movement of the slide fastener F. When the actuator 48 is driven to extend its piston rod 47, the stopper plate 46 projects into a space between the vertical walls 34 of the guide members 33, 33 with a clearance defined between the flat hollow blocks 38 and the lower edge 46*a* of the stopper plate 46. The clearance is large enough to allow the passage of individual slide fastener stringers but is narrow enough to prevent passage of the sliders S. The stopper plate 46 has a central opening 49 for the passage therethrough of the streams of air ejected from the orifices 32**.

Figure 4A:
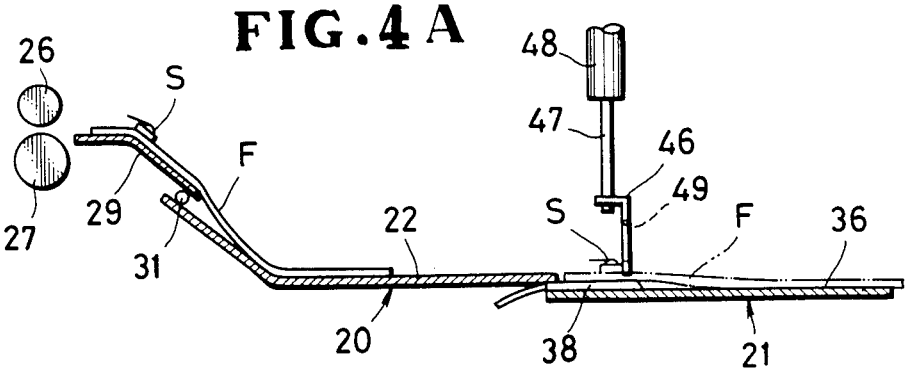
FIGS. 4A and 4B are schematic front elevational views, with parts in cross section, of the apparatus of FIG. 1, showing the manner in which good slide fasteners are sorted out from bad slide fasteners.
Figure 4B:
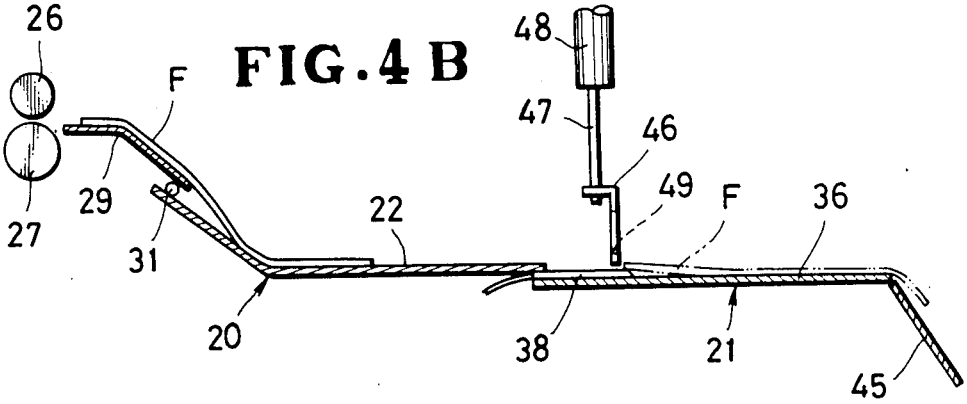

The sorting apparatus 10 thus constructed operates as follows: For the purposes of illustration, operation of the apparatus 10 begins from the position of FIG. 2 in which the stopper plate 46 is in the lowermost or holding position, the second guide 21 is in a closed position and air is ejected from the orifices 32. A slide fastener F is discharged from the fastener processing machine onto the guide plate 29 by means of the rollers 26, 27 with the slider S disposed substantially at the trailing end of the slide fastener F. The slide fastener F slides downwardly along the guide plate 29 until its leading end reaches the sloped end portion 25 of the guide surface 24. Thereafter, the slide fastener F is advanced along the sloped end portion 25 and then along the horizontal portion **24*a* of the guide surface 24 on the first guide 20 by means of the streams of air ejected from the orifices 32, as shown in FIG. 4A. Due to a layer of moving air extending between the guide surface 24 and the slide fastener F, the slide fastener F is fed in flattened form. When the leading end of the slide fastener F arrives at the second guide 21, air is ejected from the orifices 39 to flow along the upper surface of the bottom walls 36, whereupon the slide fastener F is further advanced by the streams of air ejected from the orifices 39**.

When the slide fastener F has no slider mounted thereon, it is advanced to pass through the clearance between the stopper 46 and the hollow blocks 38 by means of the streams of air ejected from the orifices 39, and is finally discharged from the apparatus 10 through the chute 45, as shown in FIG. 4A. The slide fastener F without the slider S is collected in a container (not shown) as a bad slide fastener.

On the contrary, when the slide fastener F has a slider S mounted thereon, the stopper plate 46 is engaged by the slider S to thereby arrest the movement of the slide fastener F, as shown in FIG. 4A. The slide fastener F is flattened on the lower walls 36 of the guide members 33 by means of the streams of air ejected from the orifices 39 as it is arrested by the stopper plate 46. Then, the streams of air from the orifices 32, 39 are interrupted and the actuator 43 is driven to retract its piston rod 42, whereupon the guide members 33 33 pivot about the respective hinges 37 to angularly move away from each other, as shown in FIG. 3. Thus, the slide fastener F with the slider S is allowed to fall into the container 44 and is stored therein as a good slide fastener. The slide fasteners F thus fallen from the guide members 33, 33 are disposed in the container 44 in juxtaposition. Thereafter, the actuator 43 is again driven to extend its piston rod 42 for returning the guide member 33, 33 to the closed position of FIG. 2. At the same time, air is ejected from the orifices 32.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method for sorting good flexible slide fasteners with sliders mounted thereon from defective slide fasteners without sliders, comprising the steps of:

(a) feeding the flexible slide fasteners longitudinally one at a time along a path by at least one stream of air flowing along the path, while simultaneously supporting each moving flexible slide fastener along both the length and width thereof;

(b) introducing the slide fastener while being fed, into a gate which is narrow enough to prevent the passage of sliders so that a good slide fastener having a slider is stopped at the gate, while a defective slide fastener without a slider continues to be driven in the same direction by the airstream to pass through the gate; and (c) interrupting said at least one stream of air while removing said support to thereby enable the good slide fastener which has been stopped at the gate to fall by gravity from the path.

2. A method according to claim 1, between said steps B and C, further including the step of ejecting air against the flexible slide fastener to flatten the same against its support.

3. A method according to claim 1, the slide fasteners being fed in closed condition with the sliders disposed substantially at the trailing ends of the respective slide fasteners.

4. An apparatus for sorting good flexible slide fasteners with sliders mounted thereon from defective slide fasteners without sliders, comprising:

(a) an elongate first guide having a first guide surface for guiding flexible slide fasteners longitudinally therealong, while simultaneously supporting each moving flexible slide fastener along both the length and width thereof;

(b) an elongate second guide extending from one end of said first guide and having a pair of normally juxtaposed guide members defining a second guide surface extending in longitudinal alignment with said first guide surface for guiding the slide fasteners longitudinally thereon, while simultaneously supporting each moving flexible slide fastener along both the length and width thereof, said guide members being selectively temporarily movable away from each other;

(c) means disposed on the other end of said first guide for ejecting air to produce at least one stream of air flowing along said first and second guide surfaces, to thereby feed the slide fasteners longitudinally along said first and second guide surfaces one by one;

(d) gate means disposed above said second guide and engageable with a slider of a respective one of the good slide fasteners for temporarily arresting the movement of only the good slide fastener over said juxtaposed guide members; and (e) means operatively connected to said normally juxtaposed guide members for actuating them to move temporarily laterally away from each other to enable the good slide fastener to drop by gravity off said guide members.

5. An apparatus according to claim 4, said first guide surface having an upwardly sloped end portion, said air ejecting means being disposed on an upper end of said sloped end portion and directed along said slope.

6. An apparatus according to claim 5, including a guide plate extending substantially parallel to said sloped end portion in overlapping relation to said upper end of said sloped end portion and said air ejecting means.

7. An apparatus according to claim 4, including a substantially U-shaped frame having a pair of spaced heads, and a pair of parallel spaced elongate support bars disposed on and extending between said heads, said first guide being disposed between said support bars adjacent to one of said heads, said normally juxtaposed guide members being pivotably mounted on said support bars, respectively, and angularly movable away from each other and back.

8. An apparatus according to claim 4, said air ejecting means comprising a pipe extending transversely across said first guide surface and having at least one radial orifice facing toward said one end of said first guide.

9. An apparatus according to claim 4, said arresting means comprising a stopper plate vertically movable toward and away from said second guide surface and having a lower edge extending transversely across said second guide surface, said stopper plate being normally held in a position with said lower edge being spaced from said second guide surface by a clearance therebetween, said clearance being narrow enough to prevent the passage of the slider but large enough to allow the passage of the slide fastener without the slider.

10. An apparatus according to claim 4, further including second means for ejecting air against the flexible slide fastener to flatten the same while the slide fastener is arrested over said juxtaposed guide members.

11. An apparatus according to claim 10, said second air ejecting means comprising a pair of flat hollow blocks respectively disposed on and movable with said juxtaposed guide members adjacent to said one end of said first guide, each of said hollow blocks having at least one orifice facing toward the distal end of said second guide.

* * * * *